US008257031B2

(12) United States Patent
Tsukamoto et al.

(10) Patent No.: US 8,257,031 B2
(45) Date of Patent: Sep. 4, 2012

(54) TURBO COMPRESSOR AND REFRIGERATOR

(75) Inventors: Minoru Tsukamoto, Yokohama (JP); Kentarou Oda, Yokohama (JP)

(73) Assignee: IHI Corporation (JP)

( * ) Notice: Subject to any disclaimer, the term of this patent is extended or adjusted under 35 U.S.C. 154(b) by 598 days.

(21) Appl. No.: 12/366,000

(22) Filed: Feb. 5, 2009

(65) Prior Publication Data

US 2009/0196741 A1 Aug. 6, 2009

(30) Foreign Application Priority Data

Feb. 6, 2008 (JP) ..... P2008-027073

(51) Int. Cl.
*F01D 17/12* (2006.01)

(52) U.S. Cl. ..... 415/150; 415/146; 415/157; 415/208.1; 62/498; 74/469

(58) Field of Classification Search ..... 454/299; 415/146, 150, 208.1; 62/498; 74/469
See application file for complete search history.

(56) References Cited

U.S. PATENT DOCUMENTS 3,667,860 A * 6/1972 Endress et al. ..... 415/150
5,028,208 A * 7/1991 Mitsubori et al. ..... 415/150

FOREIGN PATENT DOCUMENTS

JP H63-271059 * 5/1987
JP 2007-211716 A * 8/2007

* cited by examiner

*Primary Examiner* — Steven Loke
*Assistant Examiner* — Victoria K Hall
(74) *Attorney, Agent, or Firm* — Ostrolenk Faber LLP

(57) ABSTRACT

A position adjustment device of a turbo compressor that supports an annular member of which at least a portion is capable of being disposed in a diffuser flow path and that can be disposed in and adjusts the height of the annular member. The position adjustment device has a plurality of lever mechanisms that each have a rod connected to the annular member and are disposed separated from each other in the circumferential direction; and a transmission mechanism that transmits a drive force that at least one of the plurality of lever mechanisms has received to the other lever mechanisms. The transmission mechanism has a substantially circumferential linkage in which an open section is partially provided.

10 Claims, 9 Drawing Sheets

TURBO COMPRESSOR AND REFRIGERATOR

BACKGROUND

1. Field of the Invention

The present invention relates to a turbo compressor and refrigerator.

Priority is claimed on Japanese Patent Application No. 2008-27073, filed Feb. 6, 2008, the content of which is incorporated herein by reference.

2. Description of Related Art

There is known a variable diffuser that changes the cross-section area of a diffuser flow path in a turbo compressor. For example, Japanese Patent Application First Publication No. 2007-211716 A discloses a mechanism that supports at three points an annular member (diffuser ring) that is arranged in a diffuser flow path and transmits in a peripheral direction via a transmission means a driving force for carrying out adjusting the position of the annular member.

In a variable diffuser equipped with an annular member, a force in the axial direction resulting from the pressure difference between the front surface (the surface on the inner side in the radial direction) of the annular member and the rear surface (the surface on the outer side in the radial direction) and the like acts on an annular member.

In the above Patent Document 1 that has a wire-shaped member that is tensioned over the whole in the peripheral direction as a transmission means of the driving force, a portion of the force that acts on the annular member reaches the wire-shaped member, and so the orientation of members in the transmission means or the position adjustment means may become unstable.

Also, in the transmission means that has a circumferential linkage, adjustment of the tensile state of one section affects both neighboring sections thereof. This means there is the possibility of the influence of adjustment of a section affecting all sections. Adjustment of this kind of transmission means is complicated.

A purpose of an aspect of the present invention is to provide a turbo compressor that is capable of changing in a stable manner the position of an annular member that is disposed in a diffuser flow path.

SUMMARY

An aspect of the present invention provides a turbo compressor including a first wall and a second wall that are mutually separated in the axial direction of an impeller with a diffuser flow path formed therebetween; an annular member of which at least a portion is capable of being disposed in the diffuser flow path; and a position adjustment device that supports the annular member and adjusts the height of the annular member from the first wall or the second wall. The position adjustment device has a plurality of lever mechanisms that each have a rod connected to the annular member and are disposed separated from each other in the circumferential direction; and a transmission mechanism that transmits a drive force that at least one of the plurality of lever mechanisms has received to the other lever mechanisms. The transmission mechanism has a substantially circumferential linkage in which an open section is partially provided.

According to the aspect, the position (height) of the annular member in the diffuser flow path is adjusted by the position adjustment device. In the position adjustment device, the drive force is transmitted to the plurality of lever mechanisms via the transmission mechanism, and the position of the annular member changes by the drive force that is suitably distributed. Also, since the circumferential linkage (circumference) of the transmission mechanism has a partial open section, a portion of the force in the transmission mechanisms is released by that open section. Also, according to this aspect, adjustment of the transmission mechanism is comparatively easy. That is, in the transmission mechanism, the influence of adjustment of a section can be alleviated by at least the open section.

Another aspect of the present invention provides a refrigerator provided with the above-mentioned turbo compressor.

According to this aspect, since a stable diffuser effect is obtained, enhanced reliability is achieved.

According to an aspect of present invention, as a result of the orientation of members in the transmission mechanism or the lever mechanisms being stably maintained, it is possible to change the position of the annular member that is disposed in the diffuser flow path in a stable manner.

DETAILED DESCRIPTION

Figure 1:
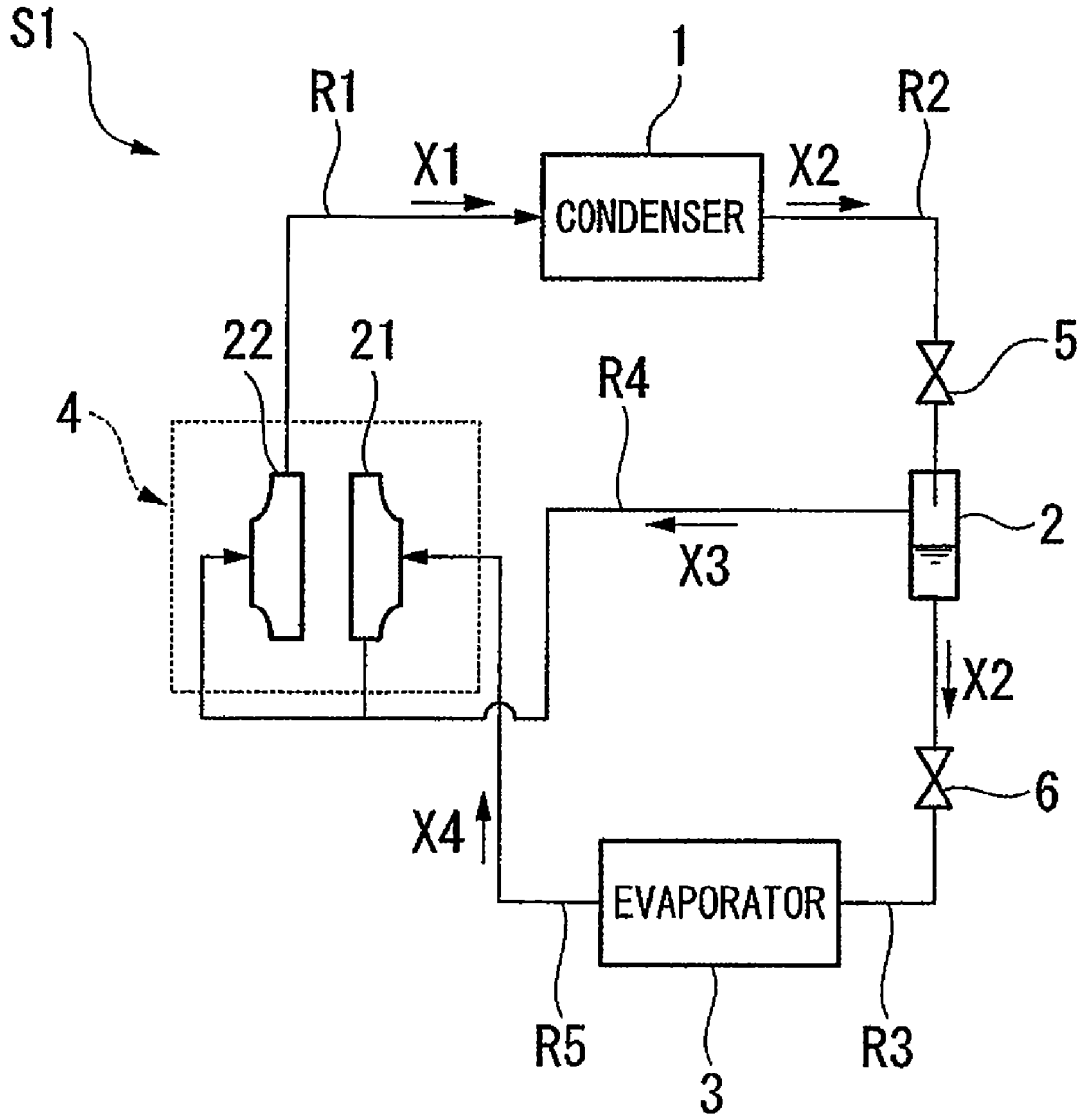
FIG. 1 is a block diagram that shows the outline constitution of a turbo refrigerator.

Hereinbelow, a first embodiment of the turbo compressor and refrigerator according to the present invention shall be described with reference to the drawings. Note that in the drawings below, the scale of components shall be suitably altered in order to make the components large enough to be recognizable.

FIG. 1 is a block diagram that shows the outline constitution of a turbo refrigerator S1 (refrigerator).

In the present embodiment, the turbo refrigerator S1 is installed in a building or a factory in order to generate the cooling water for air-conditioning, for example, and as shown in FIG. 1, it is equipped with a condenser 1, an economizer 2, an evaporator 3, and a turbo compressor 4.

In the condenser 1, a compressed refrigerant gas X1 which is a refrigerant (working fluid) that has been compressed in a gaseous state is liquefied to become a refrigerant fluid X2. As shown in FIG. 1, the condenser 1 is in fluid communication with the turbo compressor 4 via a flow path R1 through which the compressed refrigerant gas X1 flows, and is in fluid communication with the economizer 2 via a flow path R2 through which the refrigerant fluid X2 flows. An expansion valve 5 for decompressing the refrigerant fluid X2 is installed in the flow path R2.

The economizer 2 temporarily stores the refrigerant fluid X2 that was decompressed with the expansion valve 5. This economizer 2 is in fluid communication with the evaporator 3 via a flow path R3 through which the refrigerant fluid X2 flows, and is in fluid communication with the turbo compressor 4 via a flow path R4 through which a gaseous refrigerant X3 produced in the economizer 2 flows. An expansion valve 6 for further decompressing the refrigerant fluid X2 is installed in the flow path R3. The flow path R4 is in fluid communication with the turbo compressor 4 so as to supply the gaseous phase component X3 to a second compression stage 22 with which the turbo compressor 4 is equipped and which is described later.

In the evaporator 3, heat equivalent to evaporation heat is taken from a cooling object, such as water, with evaporation of the refrigerant fluid X2, and the cooling object is cooled. The evaporator 3 is in fluid communication with the turbo compressor 4 through a flow path R5 into which an evaporated refrigerant gas X4 flows. The flow path R5 is in fluid communication with a first compression stage 21 with which the turbo compressor 4 is equipped and which is described later.

The turbo compressor 4 compresses the refrigerant gas X4 to produce the above-mentioned compressed refrigerant gas X1. This turbo compressor 4 is in fluid communication with the condenser 1 via the flow path R1 through which the compressed refrigerant gas X1 flows as mentioned above, and is in fluid communication with the evaporator 3 via the flow path R5 through which the refrigerant gas X4 flows.

In the turbo refrigerator S1 constituted in this way, the compressed refrigerant gas X1 that is supplied to the condenser 1 via the flow path R1 is liquefied and cooled to become the refrigerant fluid X2. The refrigerant fluid X2 is decompressed by the expansion valve 5, and is supplied to the economizer 2 via the flow path R2. The decompressed refrigerant fluid X2 is temporarily stored in the economizer 2. The refrigerant fluid X2 from the economizer is further decompressed by the expansion valve 6, and is supplied to the evaporator 3 via the flow path R3.

The refrigerant fluid X2 supplied to the evaporator 3 evaporates to become the refrigerant gas X4. The refrigerant gas X4 is supplied to the turbo compressor 4 via the flow path R5. The refrigerant gas X4 is compressed by the turbo compressor 4 to become the compressed refrigerant gas X1, and is again supplied to the condenser 1 via the flow path R1.

The gaseous phase component X3 generated from the refrigerant fluid X2 that is stored by the economizer 2 is supplied to the turbo compressor 4 via the flow path R4. The gaseous phase component X3 is compressed with the refrigerant gas X4, and is supplied to the condenser 1 via the flow path R1 as the compressed refrigerant gas X1. In such a turbo refrigerator S1, when the refrigerant fluid X2 evaporates with the evaporator 3, a cooling object is cooled or refrigerated by taking heat from the cooling object.

Next, the turbo compressor 4 shall be described in detail.

Figure 2:
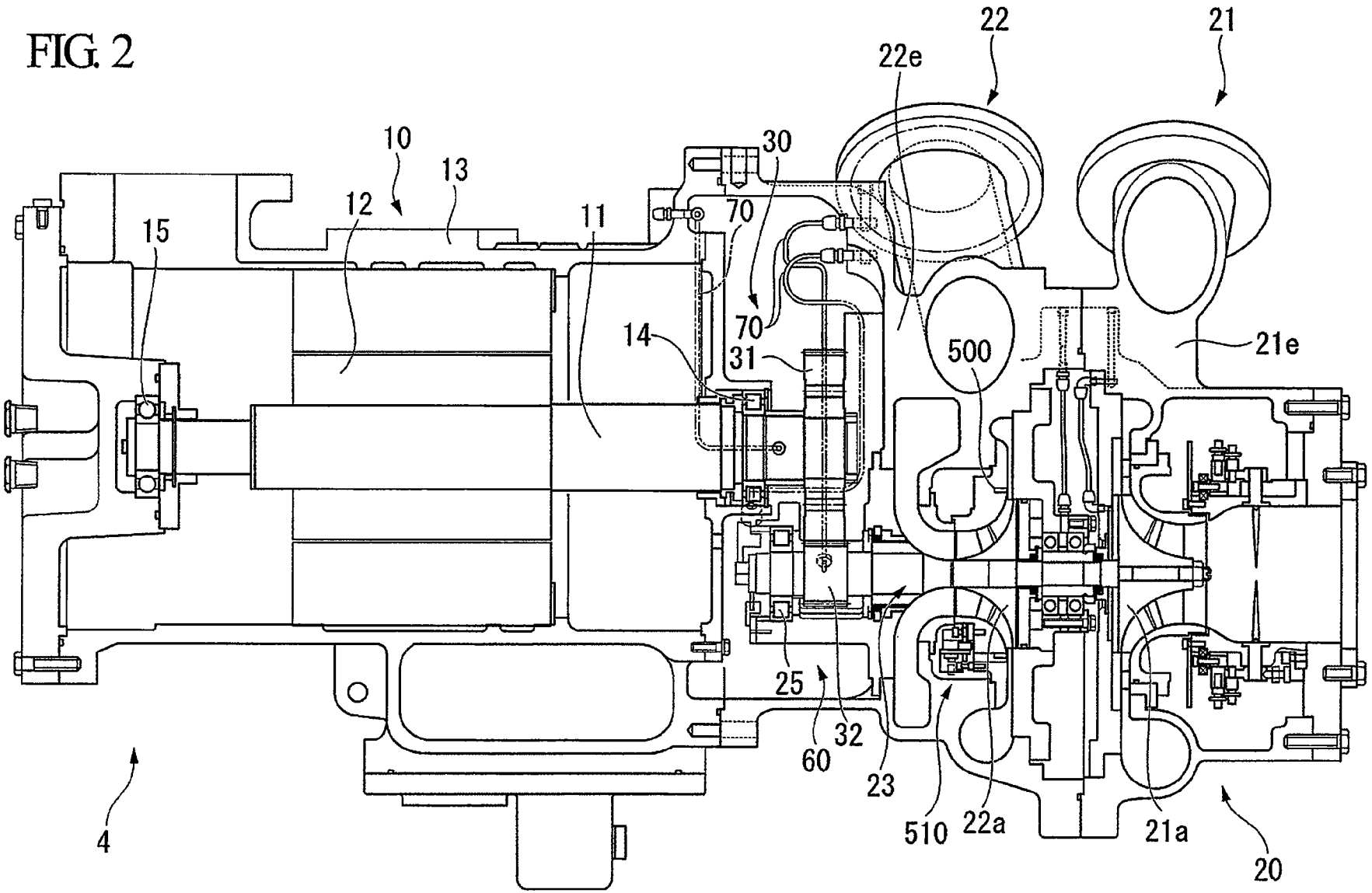
FIG. 2 is a horizontal sectional view of the turbo compressor with which the turbo refrigerator is provided.
Figure 3:
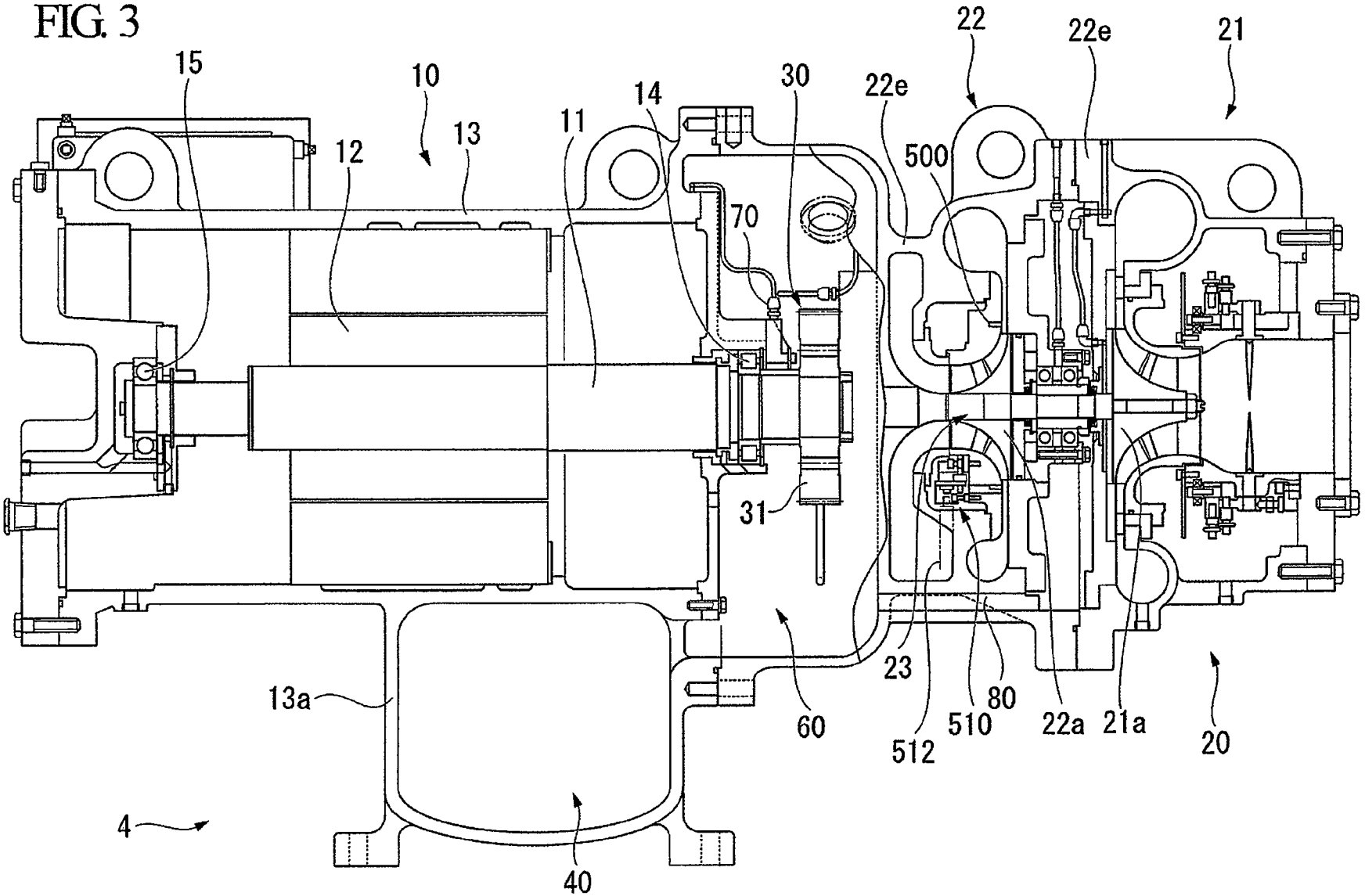
FIG. 3 is a vertical sectional view of the turbo compressor with which the turbo refrigerator is provided.
Figure 4:
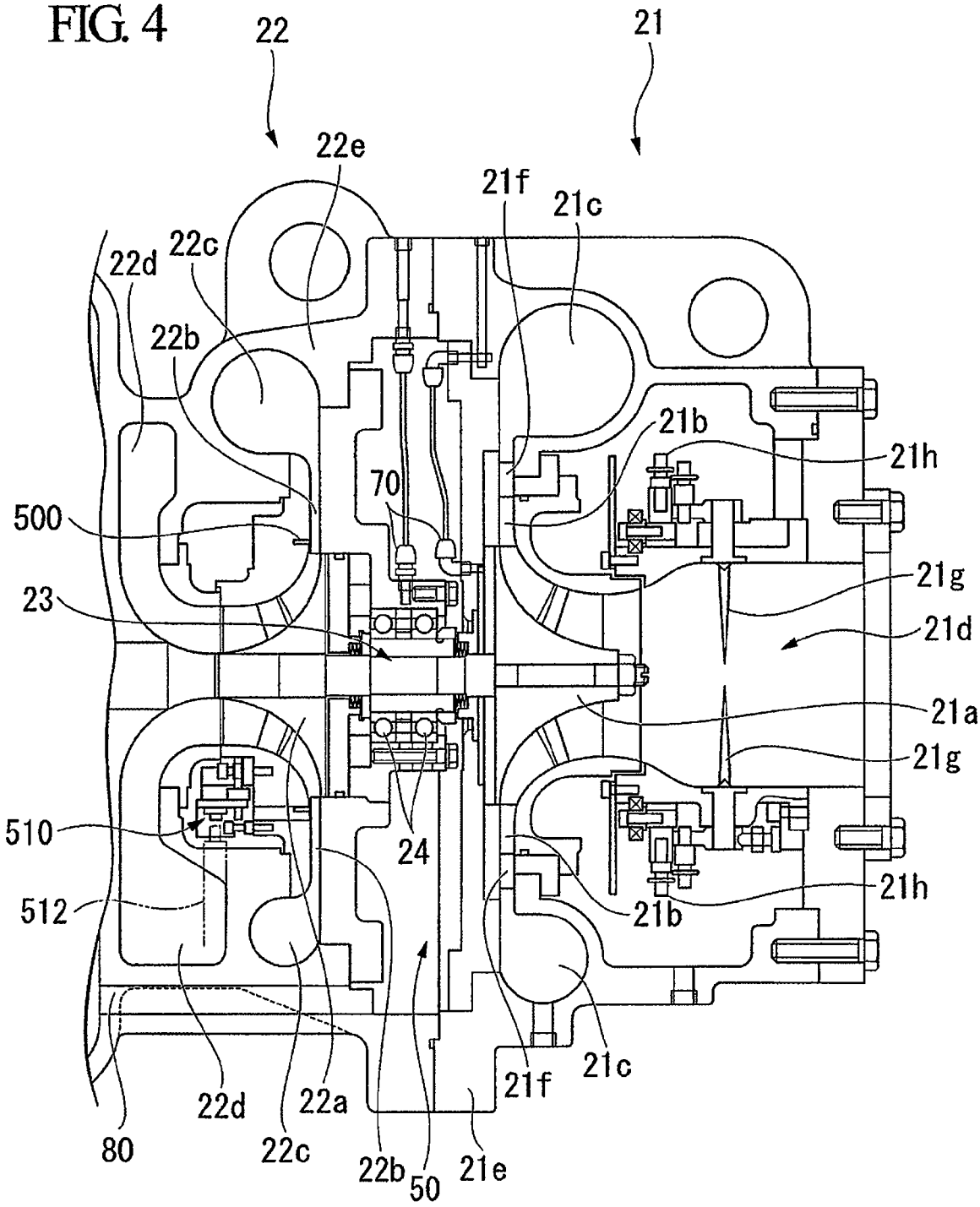
FIG. 4 is an enlargement of the principal parts of FIG. 3.

FIG. 2 is a horizontal sectional view of the turbo compressor 4. FIG. 3 is a vertical sectional view of the turbo compressor 4. FIG. 4 is an enlarged vertical section view of the compressor unit 20 with which the turbo compressor 4 is provided.

In the present embodiment, the turbo compressor 4 is equipped with a motor unit 10, the compressor unit 20, and a gear unit 30, as shown in FIGS. 2 to 4.

The motor unit 10 is provided with a motor 12 that has an output shaft 11 and consists of a drive source for driving the compressor unit 20, and a motor housing 13 that surrounds the motor 12 and supports the motor 12. The output shaft 11 of the motor 12 is rotatably supported by a first bearing 14 and a second bearing 15 which are fixed to the motor housing 13. The motor housing 13 is equipped with a leg 13*a* which supports the turbo compressor 4. The inside of the leg 13*a* is hollow, with that space being used as an oil tank 40 for recovery of the lubricant supplied to the sliding region of the turbo compressor 4.

The compressor unit 20 is equipped with a first compression stage 21 (compression means) which draws in and compresses the refrigerant gas X4 (refer to FIG. 1), and a second compression stage 22 (compression means) which further compresses the refrigerant gas X4 that was compressed by the first compression stage 21, and discharges it as the compressed refrigerant gas X1 (refer to FIG. 1).

The first compression stage 21 is provided with a first impeller 21*a* that imparts velocity energy to the refrigerant gas X4 supplied along the thrust direction (the axial direction) and leads the refrigerant gas X4 in the radial direction, a first diffuser 21*b* which has a diffuser flow path in which the velocity energy imparted to the refrigerant gas X4 by the first impeller 21*a* is converted into pressure energy, a first scroll chamber 21*c* which leads out the refrigerant gas X4 compressed by the first diffuser 21*b* to the outside of the first compression stage 21, and a suction port 21*d* which draws in the refrigerant gas X4 and leads it to the first impeller 21*a*. At least one portion of the first diff-user 21*b*, the first scroll chamber 21*c*, and the suction port 21*d* is formed by a first housing 21*e* surrounding the first impeller 21*a*.

The first impeller 21*a* is fixed to the rotation shaft 23. When the rotation shaft 23 rotates by transmission of rotation force from the output shaft 11 of the motor 12, the first impeller 21*a* is rotatively driven.

The first diffuser 21*b* has a diffuser flow path which has an annular shape surrounding the first impeller 21*a*. In the present embodiment, the first diffuser 21*b* is a vaned diff-user equipped with a plurality of diffuser vanes 21*f* that reduce the whirl speed of the refrigerant gas X4 to efficiently convert the velocity energy into pressure energy.

A plurality of inlet guide vanes 21*g* for controlling the suction flow amount of the first compression stage 21 are installed in the suction port 21*d* of the first compression stage 21. The disposed angle of each inlet guide vane 21*g* is changed by a driving mechanism 21*h* that is fixed to the first housing 21*e*. In accordance with the disposed angle of the inlet guide vanes 21*g*, the area (substantial flow path cross-sectional area) viewed from above from the flow direction of the refrigerant gas X4 can be changed.

The second compression stage 22 is provided with a second impeller 22*a* that imparts velocity energy to the refrigerant gas X4 from the first compression means 21 and leads it in the radial direction, a second diffuser 22*b* which has a diffuser flow path in which the velocity energy imparted to the refrigerant gas X4 by the second impeller 22*a* is converted into pressure energy, a second scroll chamber 22*c* which leads out the refrigerant gas X4 compressed by the second diffuser 22*b* to the outside of the second compression stage 22, and an introduction scroll chamber 22*d* which introduces the refrigerant gas X4 compressed by the first compression means 21 to the second impeller 22*a*. At least one portion of the second diffuser 22*b*, the second scroll chamber 22*c*, and the introduction scroll chamber 22*d* is formed by a second housing 22*e* surrounding the second impeller 22*a*.

The second impeller 22*a* is arranged back-to-back with the first impeller 21*a*, and is fixed to the above-mentioned rotation shaft 23. When the rotation shaft 23 rotates by transmission of rotation force from the output shaft 11 of the motor 12, the second impeller 22*a* also is rotatively driven. In another embodiment, the first impeller 21*a* and the second impeller 22*a* may be in a positional relationship other than back-to-back.

The second diffuser 22*b* has a diffuser flow path which has an annular shape surrounding the second impeller 22*a*. In the present embodiment, the second diffuser 22*b* is a vaneless diffuser not having diffuser vanes. Also, in the present embodiment, the second diffuser 22*b* has a diffuser ring 500 and a position adjustment device 510, and is capable of changing the substantive cross-sectional area of the diffuser flow path. The diffuser ring 500 and the position adjustment device 510 are described below.

The second scroll chamber 22*c* is in fluid communication with the flow path R1, and supplies the compressed refrigerant gas X1 from the second compression stage 22 to the condenser 1 via the flow path R1.

The first scroll chamber 21*c* of the first compression stage 21 and the introduction scroll chamber 22*d* of the second compression stage 22 are connected through external piping (not illustrated) that is provided independently from the first compression stage 21 and the second compression stage 22. The refrigerant gas X4 compressed by the first compression stage 21 is supplied to the second compression stage 22 via this external piping. Moreover, the above-mentioned flow path R4 (refer to FIG. 1) is in fluid communication with this external piping. The gaseous refrigerant X3 generated in the economizer 2 is supplied to the second compression stage 22 via this external piping.

The rotation shaft 23 is rotatably supported by a third bearing 24 fixed to the second housing 22*e* of the second compression stage 22 in a space 50 between the first compression stage 21 and the second compression stage 22, and a fourth bearing 25 fixed to the motor unit 10 side by the second housing 22*e*.

The gear unit 30 is housed in a space 60 that is formed by the motor housing 13 of the motor unit 10, and the second housing 22*e* of the compressor unit 20, and transmits the rotation power of the output shaft 11 of the motor 12 to the rotation shaft 23. The gear unit 30 has a large diameter gear 31 that is fixed to the output shaft 11 of the motor 12, and a small diameter gear 32 which meshes with the large diameter gear 31 while being fixed to the rotation shaft 23. In the gear unit 30, along with the rotation power of the output shaft 11 of the motor 12 being transmitted to the rotation shaft 23, the rotational frequency of the rotation shaft 23 increases with respect to the rotational frequency of the output shaft 11.

In the present embodiment, the turbo compressor 4 is provided with a lubricant-supplying device 70 that supplies the lubricant stored in the oil tank 40 to between the bearings (the first bearing 14, the second bearing 15, the third bearing 24, and the fourth bearing 25), the impellers (the first impeller 21*a* and the second impeller 22*a*) and the housings (the first housing 21*e* and the second housing 22*e*) and the sliding region of the gear unit 30 and the like. Note that in the drawings, only a portion of the lubricant-supplying device 70 is shown. The space 50 where the third bearing 24 is arranged is in fluid communication with the space 60 where the gear unit 30 is stored via a through hole 80 formed in the second housing 22*e*. Furthermore, the space 60 is in fluid communication with the oil tank 40. The lubricant which was supplied to the spaces 50 and 60 and was collected from the sliding region is sent to the oil tank 40.

Next, the operation of the turbo compressor 4 constituted in this way shall be described.

After the lubricant is supplied to the sliding region of the turbo compressor 4 by the lubricant-supplying device 70 from the oil tank 40, the motor 12 is driven. The rotation power of the output shaft 11 of the motor 12 is transmitted to the rotation shaft 23 through the gear unit 30, and the first impeller 21*a* and the second impeller 22*a* of the compressor unit 20 are rotatively driven.

When the first impeller 21*a* rotates, the suction port 21*d* of the first compression stage 21 enters a negative pressure state, and the refrigerant gas X4 from the flow path R5 flows into the first compression stage 21 through the suction port 21*d*.

In the first compression stage 21, the refrigerant gas X4 flows into the first impeller 21*a* along the thrust direction (the axial direction). The refrigerant gas X4 that is given velocity energy by the first impeller 21*a* is discharged from the first impeller 21*a* along the radial direction.

In the first diffuser 21*b*, the velocity energy of the refrigerant gas X4 is changed into pressure energy, and the refrigerant gas X4 is compressed. In the present embodiment, when the refrigerant gas X4 collides with the diffuser vanes 21*f*, the whirl speed of the refrigerant gas X4 decreases rapidly, and the velocity energy is changed into pressure energy at a high efficiency. The refrigerant gas X4 discharged from the first diff-user 21*b* is drawn to the outside of the first compression stage 21 via the first scroll chamber 21*c*, and is supplied to the second compression stage 22 via the external piping.

In the second compression stage 22, the refrigerant gas X4 from the first compression stage 21 flows into the second impeller 22*a* along the thrust direction (the axial direction) via the introduction scroll chamber 22*d*. The refrigerant gas X4 given velocity energy by the second impeller 22*a* is discharged from the second impeller 22*a* along the radial direction.

In the second diffuser 22*b*, the velocity energy of the refrigerant gas X4 is changed into pressure energy, and the refrigerant gas X4 is compressed. In the present embodiment, since the second diffuser 22*b* is vaneless, there is no generation of vibration produced when the refrigerant gas X4 collides with diffuser vanes. The compressed refrigerant gas X1 discharged from the second diffuser 22*b* is drawn to the outside by the second compression stage 22 via the second scroll chamber 22*c*.

The compressed refrigerant gas X1 from the second compression stage 22 is supplied to the condenser 1 via the flow path R1.

In the present embodiment, since the vibration in the second diffuser 22*b* is reduced, the generation of a strong vibration noise which echoes inside of the condenser 1 is prevented.

Next, the variable mechanism of the second diffuser 22*b* shall be explained in detail.

In the turbo compressor 4 shown in FIG. 4, when the suction flow rate of fluid changes, a sufficient diffuser effect may no longer be obtained. The suction flow rate may change by changing for example the output speed of the motor 12, that is, the rotational speed of for example the rotation shaft 23. Or the suction flow rate can change by controlling the disposed angle of for example the inlet guide vanes 21*g*. When the suction flow rate changes, for example, the flow direction of the fluid blown out from the first impeller 21*a* may no longer agree with the disposed direction of the diffuser pane 21*f* that is provided midway or in the vicinity of the exit of the flow path of the first diffuser 21*b*, and as a result, there is the possibility of a sufficient diffuser effect no longer being obtained.

In the present embodiment, the variable mechanism for adjusting the width (flow path cross-section area) of a diffuser flow path according to the suction flow rate of refrigerant gas (fluid) etc. is incorporated in the turbo compressor 4. In the present embodiment, a variable diffuser is provided in the second diffuser 22*b*. In another embodiment, a variable diffuser may be provided in the first diffuser 21*b*, and may be provided in both of the first and second diffusers 21*b* and 22*b*.

Figure 5:
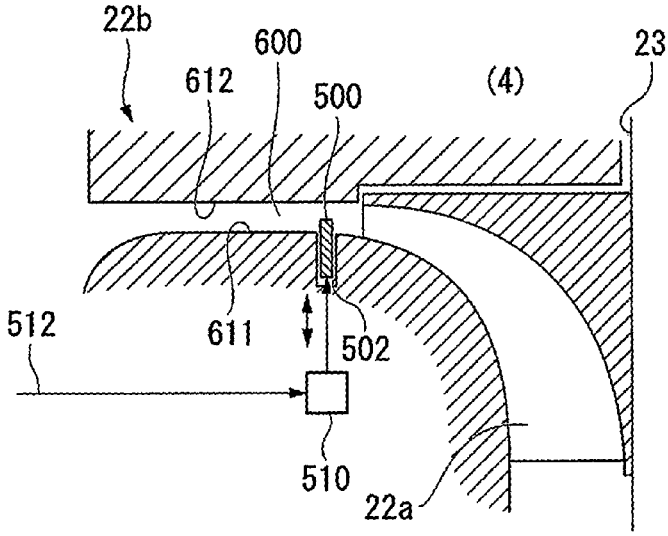
FIG. 5 is a schematic sectional view of a diffuser flow path.

FIG. 5 is a schematic sectional view showing the diffuser flow path 600 in the second diffuser 22*b*. In FIG. 5, the turbo compressor 4 is provided with first and second walls 611 and 612 that are mutually separated in the axial direction of the second impeller 22*a*, the diffuser ring 500, and the position adjustment device 510. The first and second walls 611 and 612 extend at least in the radial direction of the second impeller 22*a*. In the present embodiment, the first wall 611 and the second wall 612 can be arranged substantially parallel. In another embodiment, at least a portion of the first wall 611 may be substantially nonparallel with the second wall 612, or at least a portion of the second wall 612 may be substantially nonparallel with the first wall 611.

The entire shape of the diffuser flow path 600 that is sandwiched by the first and the second wall 611 and 612 has an annular shape surrounding the second impeller 22*a*. The fluid compressed by the second impeller 22*a* flows through the annular diffuser flow path 600 in at least the radial direction (outward in the radial direction).

In the present embodiment, the entire shape of the diffuser ring 500 has an annular shape that is concentric with the second impeller 22*a* or the diffuser flow path 600. An annular slot 502 in which the diffuser ring 500 is housed is provided in the first wall 611. In the present embodiment, the diffuser ring 500 can advance and retreat with respect to the diffuser flow path 600. The position adjustment device 510 supports the diffuser ring 500 and adjusts the height (projection height, amount of projection) of the diffuser ring 500 from the first wall 611. In the present embodiment, the projection height of the diffuser ring 500 can also substantially be made into zero.

At the position where the diffuser ring 500 is disposed, the cross-section area (width of the diffuser flow path 600) of the diffuser flow path 600 changes according to the projection height of the diffuser ring 500.

In the present embodiment, the optimal projection height of the diffuser ring 500 according to the suction flow rate in the turbo compressor 4 etc. is set using the position adjustment device 510 so that the preferred diffuser effect may be acquired in combination with the flow path of the first diffuser 21*b*.

The drive force for position adjustment is supplied to the position adjustment device 510 from the outside through a drive shaft 512. In the present embodiment, the drive shaft 512 has a knob which is not illustrated which is attached to the end portion on the opposite side of the end portion that is connected to the position adjustment device 510. By rotating the drive shaft 512 manually from the outer portion of the turbo compressor 4, drive force is supplied to the position adjustment device 510. In another embodiment, the drive shaft 512 can be connected to the output shaft of a motor such as a servo motor. A motor may be installed in the inside of the turbo compressor 4, and may also be installed outside. In this case, the supply timing and the supply amount of the drive force are controllable via the motor.

Figure 6:
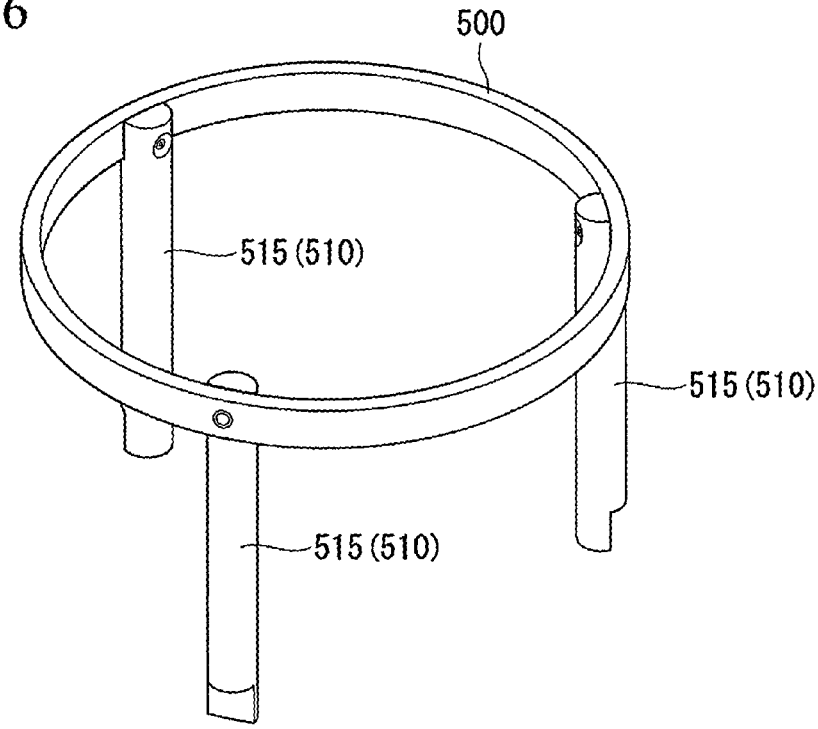
FIG. 6 is a schematic perspective view that shows a diffuser ring.

FIG. 6 is a schematic perspective view showing the diffuser ring 500. In the present embodiment, as shown in FIG. 6, the length in the axial direction of the diffuser ring 500 (width in the axial direction) is long compared to that in the radial direction (radial width, thickness of the diffuser ring 500). In another embodiment, the length in the axial direction of the diffuser ring 500 can be made substantially the same or shorter than that in the radial direction.

Three rods 515 are attached to the diffuser ring 500 in FIG. 6. The three rods 515 are separated at a substantially equal interval in the circumferential direction of the diffuser ring 500. One end of each rod 515 is fixed to the diffuser ring 500 via a bolt or the like. Following movement of the rod 515 in the axial direction, the diffuser ring 500 moves in the axial direction. In the present embodiment, one end portion of the rods 515 is fixed to the inner circumference side of the diffuser ring 500. In another embodiment, the rods 515 may be fixed to another suitable place of the diffuser ring 500. Moreover, in another embodiment, the number of rods 515 can be 2, 4, 5, 6, 7, 8, 9, or 10 or more. When the number of rods 515 is 3, adjustment of the diffuser ring 500 is comparatively easy.

Figure 7:
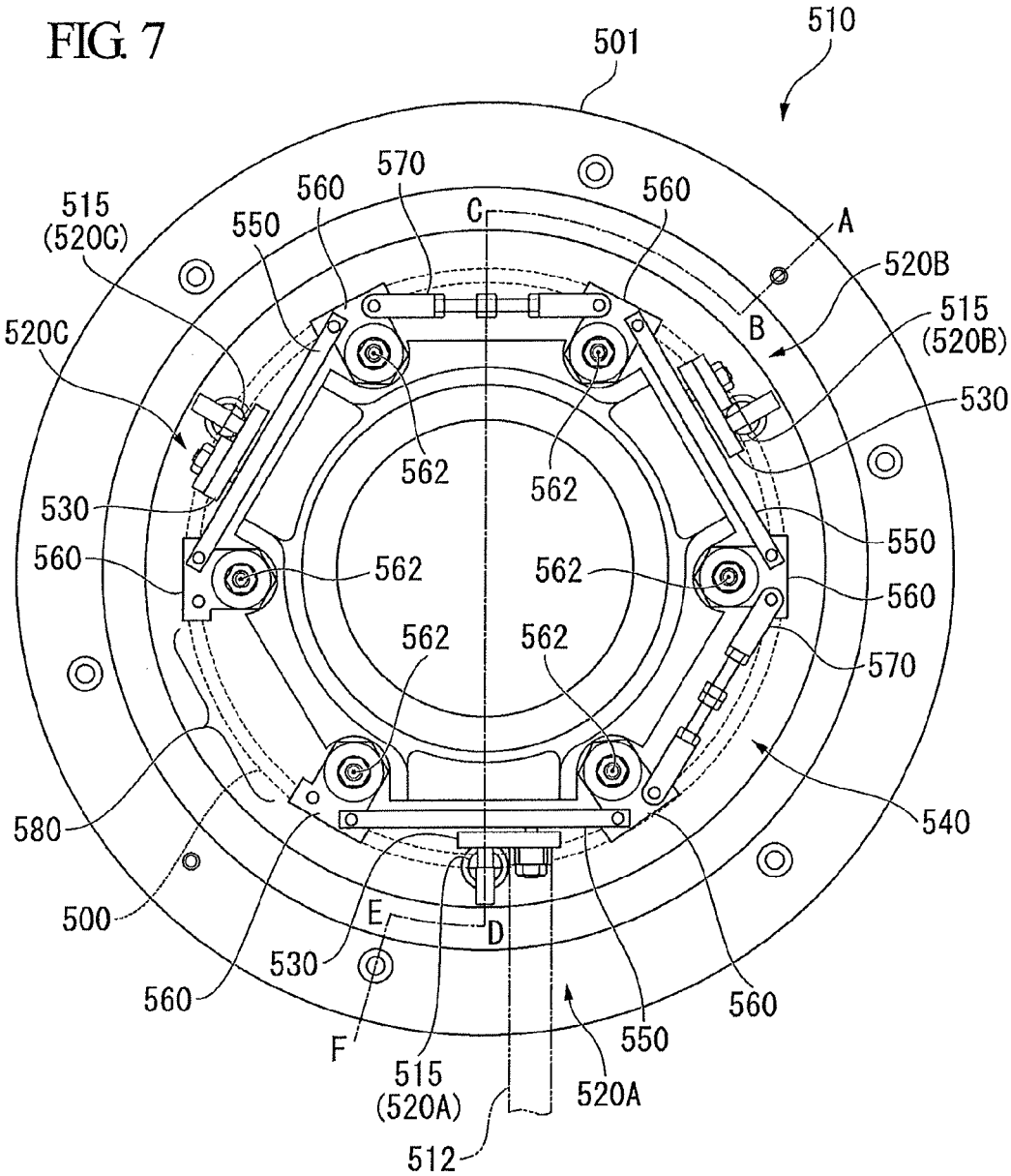
FIG. 7 is a plan view that shows a position adjustment device.
Figure 8:
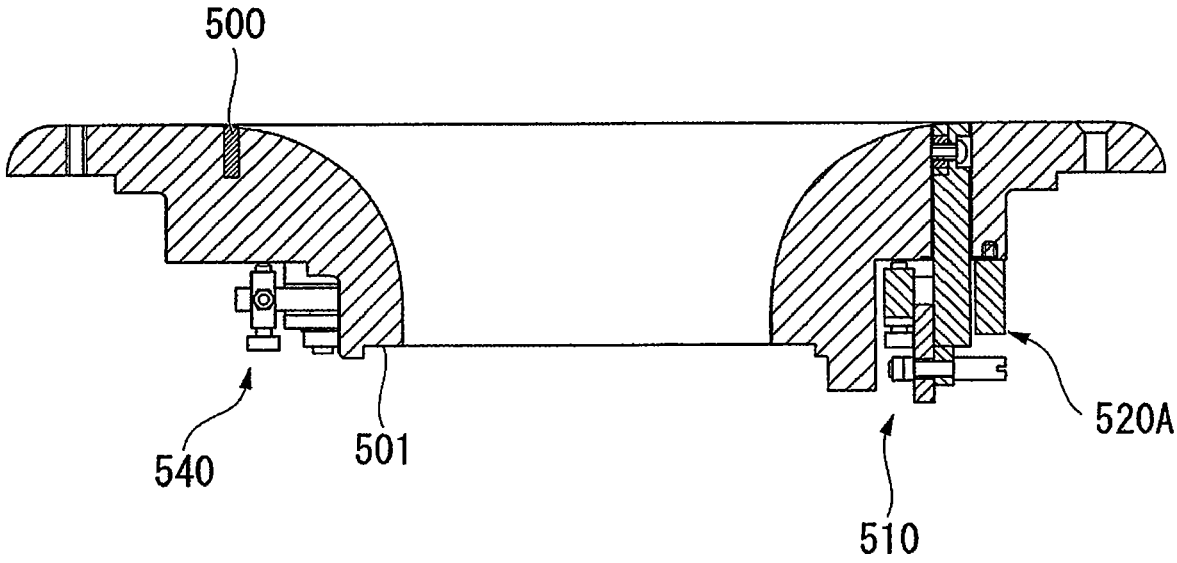
FIG. 8 is a sectional view that shows a casing and a position adjustment device along lines A-B-C-D-E-F shown in FIG. 7.

FIG. 7 is a plan view that shows a position adjustment device 510, and FIG. 8 is a sectional view that shows a casing 501 and a position adjustment device along lines A-B-C-D-E-F shown in FIG. 7.

In FIG. 7 and FIG. 8, the position adjustment device 510 has three lever mechanisms 520A, 520B, and 520C that each have one of the rods 515 and are disposed separated from each other in the circumferential direction, and a transmission mechanism 540 which transmits the drive force that at least one of the three lever mechanisms 520A, 520B, and 520C has received to the other lever mechanisms. In the present embodiment, the drive force from the drive shaft 512 is transmitted to the one lever mechanism 520A. The transmission mechanism 540 transmits the drive force which the lever mechanism 520A has received to the other lever mechanisms 520B and 520C.

Figure 9A:
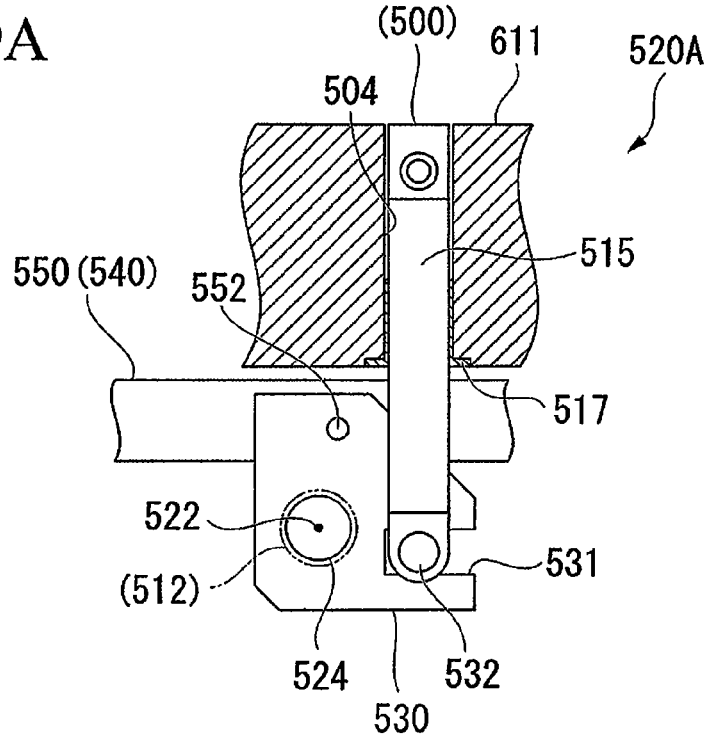
FIG. 9A is a schematic front view that shows the lever mechanism.
Figure 9B:
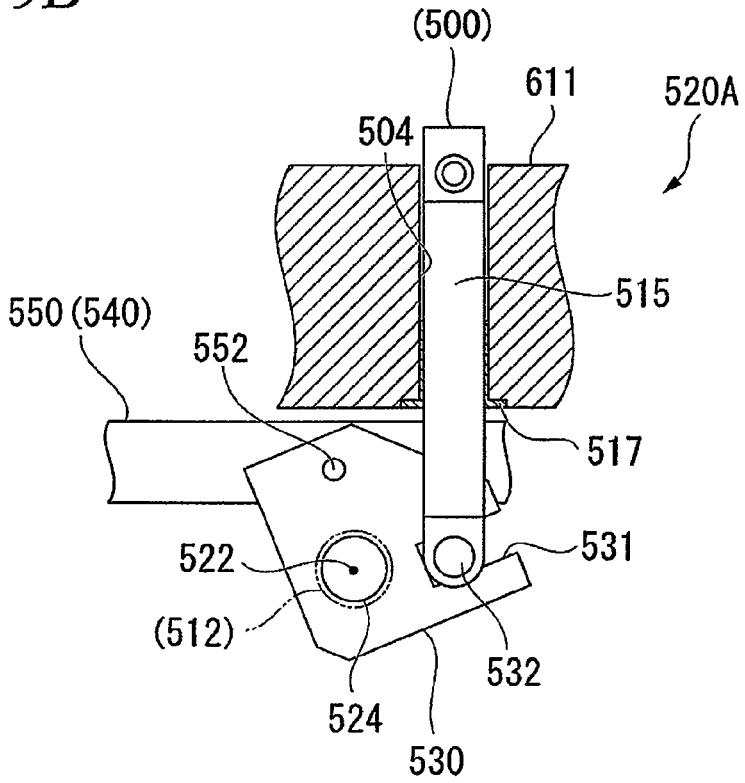
FIG. 9B is a schematic front view that shows the lever mechanism.

FIG. 9A and FIG. 9B are schematic front views showing the lever mechanism 520A. The other lever mechanisms 520B and 520C have the same constitution as the lever mechanism 520A.

In FIG. 9A and FIG. 9B, the lever mechanism 520A has the above-mentioned rod 515, a bush 517, a connecting shaft 524, a swing lever 530, and a connecting shaft 532. The bush 517 and the rod 515 are inserted in a hole 504 provided in the casing 501. Movement in the axial direction of the rod 515 is guided by the bush 517.

The connecting shaft 524 is connected with the casing 501 so that the swing lever 530 can swing. The swing lever 530 can be swung centered on the shaft center (fulcrum 522) of the connecting shaft 524.

In the present embodiment, the drive shaft 512 is connected to the swing lever 530 of the lever mechanism 520A. Specifically, one end of the drive shaft 512 is fixed to the swing lever 530, and the axial center of the drive shaft 512 is in agreement with the fulcrum of the swing lever 530 (shaft center of the connecting shaft 524). When the drive shaft 512 rotates, the angle at which the swing lever 530 is disposed will change centered on the fulcrum 522.

The connecting shaft 532 connects the swing lever 530 and the rod 515, and converts the swing motion of the swing lever 530 into linear motion in the axial direction. The shaft center of the connecting shaft 532 is arranged to the side of the center of swinging of the swing lever 530 (shaft center of the connecting shaft 524). That is, the shaft center of the connecting shaft 532 is positioned to the side of the center of swinging along a direction that is perpendicular to the movement direction of the rod 515. A slot 531 in which the connecting shaft 532 is inserted and allows changes in the distance between the connecting shaft 532 and the shaft center is provided in the swing lever 530. Following the swing of the swing lever 530, the connecting shaft 532 and a rod 515 perform linear motion along the axial direction, and, as a result, the projection height of the diffuser ring 500 from the first wall 611 changes.

As shown in FIG. 9A and FIG. 9B, the transmission lever 550 of the transmission mechanism 540 is also connected to the swing lever 530. The connecting shaft 552 connects the swing lever 530 and the transmission lever 550. The shaft center of the connecting shaft 552 is located on the side facing the movement direction of the rod 515 with respect to the center of swinging (shaft center of the connecting shaft 524). The transmission lever 550 extends at least in the direction perpendicular to the movement direction of the rod 515 (extending direction of the rod 515). Following the swinging of the swing lever 530, the shaft center of the transmission lever 550 (connecting shaft 552) swings centered on the fulcrum 522 (the shaft center of the connecting shaft 524). Also, following the swinging of the swing lever 530, the angle at which the swing lever 530 is disposed with respect to the transmission lever 550 changes via the connecting shaft 552, and the position of the transmission lever 550 shifts.

Returning to FIG. 7, the transmission mechanism 540 has three of the above-mentioned transmission levers 550. That is, the transmission mechanism 540 has three transmission levers 550 connected respectively to the lever mechanisms 520A, 520B, and 520C. Furthermore, the transmission mechanism 540 has six relay members 560 and two variable joints 570.

In the present embodiment, as shown in FIG. 7, six relay members 560 are arranged at a pitch of approximately 60 degree along the circumferential direction of the diffuser ring 500. Moreover, the transmission levers 550 and the variable joints 570 are alternately arranged along the circumferential direction of the diffuser ring 500. One end portion of each transmission lever 550 is connected to one relay member 560, and the other end portion is connected to the next relay member 560. Moreover, one end portion of each variable joint 570 is connected with one relay member 560, and the other end portion is connected with the next relay member 560.

Figure 10:
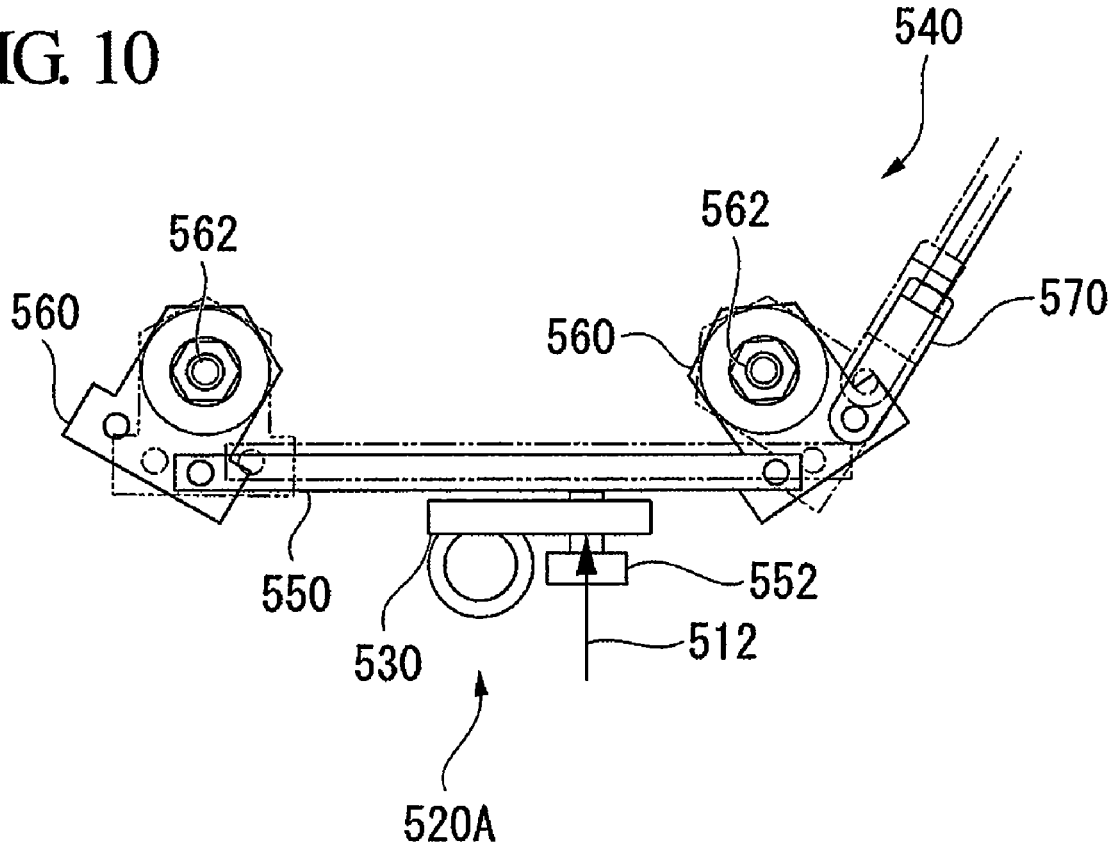
FIG. 10 is a drawing for describing the movement of the lever mechanism.

Each relay member 560 is attached to the casing 501 and freely swings centered on each shaft center 562 (shown in FIGS. 7 and 10). The shaft (long shaft) of the transmission levers 550 and the variable joints 570 connected to the relay members 560 extend at least in the tangential direction of the diffuser ring 500.

As shown in FIG. 10, when drive force is supplied via the drive shaft 512 to the lever mechanism 520A, the position of the transmission lever 550 along the tangential direction of the diff-user ring 500 will shift at least. Displacement of the transmission lever 550 in the radial direction of the diffuser ring 500 is permitted by the connecting shaft 552 (refer to FIG. 9) of the lever mechanism 520A and the like. Following motion of the transmission lever 550, the two relay members 560 connected to the transmission lever 550 swing. Moreover, the variable joint 570 connected to one of the relay members 560 moves.

Returning to FIG. 7, in the transmission mechanism 540, if the transmission lever 550 corresponding to the lever mechanism 520A moves, the transmission levers 550 respectively corresponding to the lever mechanisms 520B and 520C will move in synchronization via the relay member 560 and the variable joint 570. That is, in the present embodiment, the transmission mechanism 540 has a plurality of connecting means (three transmission levers 550, six relay members 560, and two variable joints 570) that constitute a substantially circumferential linkage (circumferential relation).

The drive force which the lever mechanism 520A receives travels to the next lever mechanism 520B, and moreover travels further to the next lever mechanism 520C. That is, the drive force that the one lever mechanism 520A has received is transmitted to the other lever mechanisms 520B and 520C via the transmission mechanism 540. As a result, the lever mechanisms 520A, 520B, and 520C which are mutually separated in the circumferential direction move substantially simultaneously. In each of the lever mechanisms 520B and 520C, following movement of the transmission lever 550, along with swinging of the swing lever 530, the rod 515 performs straight-line motion in the axial direction. At this time, the rods 515 of the lever mechanisms 520A, 520B, and 520C move in the direction of the shaft in synchronization, and the position (projection height) in the axial direction of the diffuser ring 500 changes. That is, the position adjustment device 510 can change in a stable manner the position of the diffuser ring 500 by the drive force being suitably distributed in the three lever mechanisms 520A, 520B, and 520C.

In present embodiment, the lever mechanism 520A and the lever mechanism 520B have a relation of being adjacently arranged. Between the transmission lever 550 corresponding to the lever mechanism 520A and the transmission lever 550 corresponding to the lever mechanism 520B, the variable joint 570 connecting them is disposed. Similarly, the lever mechanism 520B and the lever mechanism 520C have a relation of being adjacently arranged. Between the transmission lever 550 corresponding to the lever mechanism 520B and the transmission lever 550 corresponding to the lever mechanism 520C, the variable joint 570 connecting them is disposed.

The lever mechanism 520C and the lever mechanism 520A have a relation of being adjacently arranged. However, a connecting means is not disposed between the transmission lever 550 corresponding to the lever mechanism 520A and the transmission lever 550 corresponding to the lever mechanism 520B.

Thus, in the present embodiment, an open section 580 with a circumferential linkage is partially provided between the lever mechanism 520C and the lever mechanism 520A. This is advantageous in respect of the stability of the member orientation in the position adjustment device 510 and the ease of tension adjustment.

Here, in FIG. 5, when the fluid from the second impeller 22*a* flows through the diffuser flow path 600, a force in the axial direction acts on the diffuser ring 500 that arises from a pressure differential between the front surface (the surface on the inner side in the radial direction) of the diffuser ring 500 and the rear surface (the surface on the outer side in the radial direction) of the diffuser ring 500. The force in the axial direction that acts on the diffuser ring 500 normally is in the direction in which the diffuser ring 500 is lifted toward the diffuser flow path 600.

This axial direction force that stems from the fluid flow travels to the swing lever 530 of the lever mechanism 520A, and the transmission lever 550 of the transmission mechanism 540 in FIG. 9A and FIG. 9B. A stress along the tangential direction of the diffuser ring 500 acts on the transmission lever 550.

In FIG. 7, the stress resulting from a fluid flow similarly acts also on the transmission levers 550 corresponding to the other lever mechanisms 520B and 520C. The direction of the stress that acts on the three transmission levers 550 is mutually the same direction in the circumferential linkage (circumference) of the transmission mechanism 540. In the present embodiment, the direction of the stress that acts on the transmission lever 550 corresponding to the lever mechanism 520A is a direction heading from the lever mechanism 520A toward the lever mechanism 520B in circumferential linkage (circumferential relation). That is, all of the directions of the stresses that act on the three transmission levers 550 are directions from the lever mechanism 520A toward the lever mechanism 520C in circumferential linkage (anticlockwise in FIG. 7). In another embodiment, all of the directions of the stresses which act on the three transmission levers 550 can also be made into the direction heading from the lever mechanism 520C to the lever mechanism 520A in circumferential linkage (clockwise in FIG. 7).

In the transmission mechanism 540, stress along the same direction in the circumferential linkage based on a fluid flow acts on a plurality of connecting means that constitute a circumferential linkage (three transmission levers 550, six relay member 560, and two variable joints 570). Since the direction of the force based on the fluid flow that acts on the transmission mechanism 540 is the same in all of the transmission mechanisms 540, the orientation of the three lever mechanisms 520A, 520B, and 520C connected to the transmission mechanism 540 is maintained stably.

In the present embodiment, the transmission of force along the direction heading from the lever mechanism 520A toward the lever mechanism 520C in circumferential linkage is interrupted at the transmission lever 550 corresponding to the lever mechanism 520C. That is, in the transmission mechanism 540, the transmission of force along the one direction in circumferential linkage is released in the open section 580. The open section 580 in circumferential linkage in the transmission mechanism 540 that is provided between the lever mechanism 520C and the lever mechanism 520A contributes to the uniformity of direction of the stresses which act on the transmission mechanism 540. In the case of there not being a partial open section in the circumferential linkage of the transmission mechanism 540 so that the circumference is completely closed, there is the possibility of causing a distortion of the orientation in at least a portion of the transmission mechanism 540 and/or the lever mechanisms 520A, 520B, and 520C.

In the present embodiment, the orientation of members in the transmission mechanism 540 and the lever mechanisms 520A, 520B, and 520C is stably maintained by release of the force in the open section 580. As a result, the position adjustment device 510 can change the height position of the diffuser ring 500 in a stable manner.

Moreover, in FIG. 7, adjustment of the circumferential tension of the transmission mechanism 540 can be performed using two of the variable joints 570. For example, the shaft length of the variable joint 570 between the lever mechanism 520A and the lever mechanism 520B is adjusted first, and then the shaft length of the variable joint 570 between the lever mechanism 520B and the lever mechanism 520C is adjusted. The influence of adjustment of the shaft length of one of the variable joints 570 travels to the other the variable joint 570 through the transmission lever 550 and the relay member 560 and the like.

In the present embodiment, transmission of the influence of adjustments using the variable joint 570 is interrupted by the open section 580. In the case of there not being a partial open section in the circumferential linkage of the transmission mechanism 540 so that the circumference is completely closed, when the shaft length of one variable joint 570 is adjusted, the influence thereof extends to that variable joint 570 itself without being interrupted. Due to the influence of the adjustment in the variable joint 570 being released by the open section 580 in the circumference, it is possible to carry out easy and precise adjustment work.

In the present embodiment, the open section 580 adjoins the lever mechanism 520A in that receives the drive force. This contributes to the uniformity of direction of the stresses that act on the transmission mechanism 540. Due to the direction of the force being stable in one direction in the circumferential linkage, smooth motion of the position adjustment device 510 is derived.

In another embodiment, it is also possible to provide the open section in the circumferential linkage at a position removed from the lever mechanism that receives the drive force. In this case, the constitution of the lever mechanism between one lever mechanism that adjoins the lever mechanism that receives the drive force and the adjoining other lever mechanism may differ.

Also, in another embodiment, it is also possible to use a wire-shaped member (a wire) as a portion of the connecting means that constitutes the circumferential linkage. Even in the case of using a wire-shaped member, by providing a partial open section in the circumference, it is possible to obtain such merits as stability of the member orientation in the position adjustment device and ease of tension adjustment.

Note that in another embodiment, it is possible to apply the above-mentioned variable diffuser (the diffuser ring 500, the position adjustment device 510) to a single-stage turbo compressor. Or in another embodiment, it is possible to make the number of stages of the turbo compressor 3, 4, 5, 6, 7, 8, 9, or 10 or more.

Moreover, in another embodiment, it is also possible to apply the above-mentioned variable diffuser to a vaned-diffuser.

Moreover, in another embodiment, it is also possible to apply the above-mentioned turbo compressor to a refrigerator or freezer for home use or business-use, and an air-conditioner for home use.

While preferred embodiments of the invention have been described and illustrated above, it should be understood that these are exemplary of the invention and are not to be considered as limiting. The above-described numerical values are merely exemplary; the other numerical values can be used. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

a first wall and a second wall that are mutually separated in an axial direction of an impeller with a diffuser flow path formed therebetween;

an annular member of which at least a portion is capable of being disposed in the diffuser flow path; and a position adjustment device that supports the annular member and adjusts the height of the annular member from the first wall or the second wall, wherein the position adjustment device comprises:

a plurality of lever mechanisms that each have a rod connected to the annular member and are disposed separated from each other in the circumferential direction, each rod being guided in the axial direction;

a transmission mechanism that transmits a drive force that at least one of the plurality of lever mechanisms has received to the other lever mechanisms and has a substantially circumferential linkage in which an open section is partially provided;

a plurality of connecting portions each of which connects the lever mechanism and the transmission mechanism, the open section positioned adjacent to two connecting portions; and the transmission mechanism including at least one variable joint which adjusts a tension of the substantially circumferential linkage.

2. The turbo compressor according to claim 1, wherein the open section is adjacent to one of the plurality of lever mechanisms that receives the drive force.

3. The turbo compressor according to claim 1, wherein the direction of rotation along the circumferential linkage, resulting from force applied to one lever mechanism, based on a fluid flow in the diffuser flow path that travels from the plurality of lever mechanisms to the transmission mechanism is the same between the plurality of lever mechanisms.

4. The turbo compressor according to claim 2, wherein the direction of rotation along the circumferential linkage, resulting from force applied to one lever mechanism, based on a fluid flow in the diffuser flow path that travels from the plurality of lever mechanisms to the transmission mechanism is the same between the plurality of lever mechanisms.

5. A refrigerator provided with the turbo compressor according to claim 1.

6. A refrigerator provided with the turbo compressor according to claim 2.

7. A refrigerator provided with the turbo compressor according to claim 3

8. A refrigerator provided with the turbo compressor according to claim 4.

9. The turbo compressor according to claim 1, wherein the transmission mechanism comprises at least two variable joints and at least three transmission levers.

10. The turbo compressor according to claim 9, wherein the variable joint and the transmission lever are alternately arranged along the circumferential direction of the annular member.

* * * * *